US008882231B2

(12) United States Patent
Morgan et al.

(10) Patent No.: US 8,882,231 B2
(45) Date of Patent: Nov. 11, 2014

(54) INKJET PRINTERS

(75) Inventors: Jonathan Morgan, Cambridge (GB); Stuart Mark Walkington, St. Albans (GB); Brian Patrick Guinee, St. Neots (GB); Martin Davie Greaves, Bury St Edmunds (GB); Anthony Christopher Hunter Hardman, Swavesey (GB)

(73) Assignee: Domino Printing Sciences PLC (GB)

( * ) Notice: Subject to any disclaimer, the term of this patent is extended or adjusted under 35 U.S.C. 154(b) by 0 days.

(21) Appl. No.: 13/885,239

(22) PCT Filed: Nov. 21, 2011

(86) PCT No.: PCT/GB2011/052275

§ 371 (c)(1),
(2), (4) Date: Jul. 12, 2013

(87) PCT Pub. No.: WO2012/066356

PCT Pub. Date: May 24, 2012

(65) Prior Publication Data

US 2013/0286077 A1 Oct. 31, 2013

(30) Foreign Application Priority Data

Nov. 19, 2010 (GB) ..... 1019679.8

(51) Int. Cl.
*B41J 29/377* (2006.01)
*B41J 2/175* (2006.01)
*B41J 2/185* (2006.01)
*B41J 2/18* (2006.01)

(52) U.S. Cl.
CPC ... *B41J 2/18* (2013.01); *B41J 2/185* (2013.01)
USPC ..... 347/18; 347/85

(58) Field of Classification Search
None
See application file for complete search history.

(56) References Cited

U.S. PATENT DOCUMENTS

| | | | | |
|---|---|---|---|---|
| 4,283,730 | A | 8/1981 | Graf | |
| 2006/0139419 | A1 * | 6/2006 | Shigemura | 347/85 |
| 2009/0160899 | A1 | 6/2009 | Okada | |
| 2010/0283808 | A1 | 11/2010 | Terakado et al. | |

FOREIGN PATENT DOCUMENTS

| | | |
|---|---|---|
| EP | 0076914 | 4/1983 |
| EP | 0123523 | 10/1984 |
| EP | 0560332 | 3/1993 |
| JP | 1-247167 | 10/1989 |
| WO | 9317869 | 9/1993 |
| WO | 2008117013 | 10/2008 |

* cited by examiner

*Primary Examiner* — Geoffrey Mruk
(74) *Attorney, Agent, or Firm* — Price Heneveld LLP

(57) ABSTRACT

The invention describes a method of and means for reducing solvent consumption in a continuous inkjet printer that comprises cooling the ink within the printer system. Ink from the ink reservoir is preferably circulated through a heat exchanger.

4 Claims, 2 Drawing Sheets

INKJET PRINTERS

FIELD OF THE INVENTION

This invention relates to inkjet printers and, more particularly, to a method of and/or means for reducing solvent consumption in continuous inkjet printer.

BACKGROUND TO THE INVENTION

Continuous inkjet printing involves the formation of electrically charged drops from a jet of ink, and the subsequent deflection of the charged drops by an electric field to produce an image on a print medium. In a typical embodiment of a single jet printer of this type, electrically conducting ink is forced through a nozzle by applying pressure to the ink. The velocity of the jet requires control; often achieved by control of the constituency of the ink in conjunction with controlling the pressure. Pressure control is usually achieved by varying the speed of the pump producing the flow with feedback from a pressure transducer. It has also been achieved using feedback from a velocity measurement device.

Within a typical continuous inkjet printer, ink is re-circulated constantly from, and back to, an ink reservoir. A small proportion of the circulating ink is lead off to the print head feed line and, of the ink passing through the feed line to the print head, the un-printed ink drops are collected in the print head gutter and returned to the ink reservoir as well.

Keeping the constituency of the ink at a constant composition is normally achieved by controlling its viscosity, and adding one or more solvents to replace the solvents that have evaporated from running the continuous jet.

Many attempts have been made to reduce the amount of solvent consumed. For example European Patent Application No. 0 123 523 (Willet) and European Patent Application No. 0 560 332 (Hitachi) both disclose re-circulating the air returned from the gutter to the reservoir so that, after a short period of time, the air in the print head is saturated and the loss of solvent is minimised. A similar system is disclosed in U.S. Pat. No. 4,283,730, which describes the recirculation of solvent laden air to the print head. International Patent Application WO2008117013 (Linx) discloses feeding a portion of air back to the head because feeding solvent-laden air back into the print head can cause problems at low temperature e.g. where solvent-laden air condenses onto the print head electrodes causing failure. The outlined solution is to allow part of the air to be vented to atmosphere rather than back to the print head and to place the recirculation pipe close to the gutter.

Another problem with re-circulating gutters is that, if the return pipe becomes blocked, there is a tendency for the reservoir to become pressurised and to burst as air is drawn in by the gutter pump and can't escape.

European Patent 0 076 914 purports to describe a continuous inkjet printer in which the evaporation rate of the ink is low. In the embodiment described a heat exchanger is provided in the ink feed line, just upstream of the drop generator, and this is said to cool the ink and, thereby, reduce evaporation of the ink. No description is provided of any system to add solvent to the ink but, in any event, the apparatus described will have negligible effect on the temperature of the ink, and any solvent consumption, because the ink flow through the print head is extremely low. Typically, of the ink circulating within the printer, approximately 0.5% of the flow is directed through the print head. Still further, current continuous inkjet printers include a heating facility to heat the ink and obviously such a facility makes the arrangement shown in EP 0 076 914 pointless.

A further method used to reduce solvent consumption is to use a Peltier cooler in the vent line from the ink reservoir. The Peltier cooler condenses solvent and returns it either to the ink reservoir or to the make-up reservoir. A Peltier cooler is used for example on the applicant's A-Series printer. Although this method is effective, Peltier coolers are inefficient and expensive.

It is an object of the invention to provide a continuous inkjet printer which will go at least some way in addressing the aforementioned problems; or which will at least offer a novel and useful alternative.

SUMMARY OF THE INVENTION

Accordingly the invention provides a method of reducing make-up consumption in a continuous inkjet printer having an ink re-circulation circuit and a print head feed line, said method comprising cooling ink passing through said ink re-circulation circuit.

Preferably said ink re-circulation circuit begins and terminates in an ink reservoir, said method comprising subjecting said ink to cooling whilst external to said reservoir.

Preferably said method comprises passing said ink through a heat exchanger.

Preferably said method includes positioning said heat exchanger in a forced-air stream.

In a second aspect the invention provides a continuous inkjet printer having an ink re-circulation circuit and a print head feed line, said printer being characterised in that an ink cooling facility is provided within said ink re-circulation circuit.

Preferably said printer includes an ink reservoir, said ink re-circulation circuit beginning and terminating in said ink reservoir, said ink cooling facility being provided within said ink re-circulating circuit external to said reservoir.

Preferably said cooling facility comprises a heat exchanger.

Preferably said printer further includes a fan to pass an air stream over said heat exchanger.

Many variations in the way the present invention can be performed will present themselves to those skilled in the art. The description which follows is intended as an illustration only of one means of performing the invention and the lack of description of variants or equivalents should not be regarded as limiting. Wherever possible, a description of a specific element should be deemed to include any and all equivalents thereof whether in existence now or in the future.

BRIEF DESCRIPTION OF THE DRAWINGS

One embodiment of the invention will now be described with reference to the accompanying drawings in which.

DESCRIPTION OF WORKING EMBODIMENT

It will be apparent from the description above that past attempts to minimise solvent make-up consumption have concentrated on treating the solvent laden air returned from the print head gutter. The characteristic feature of this invention arises from the surprising observation that by cooling the ink within the re-circulation circuit of a continuous inkjet printer, and particularly the body of ink with the ink reservoir, solvent consumption can be reduced significantly. Whilst some form of cooler could be provided directly in the ink reservoir, for cost and simplicity it is convenient to draw ink from the reservoir, pass it through a heat exchanger, and then pass the cooled ink back into the reservoir.

Figure 1:
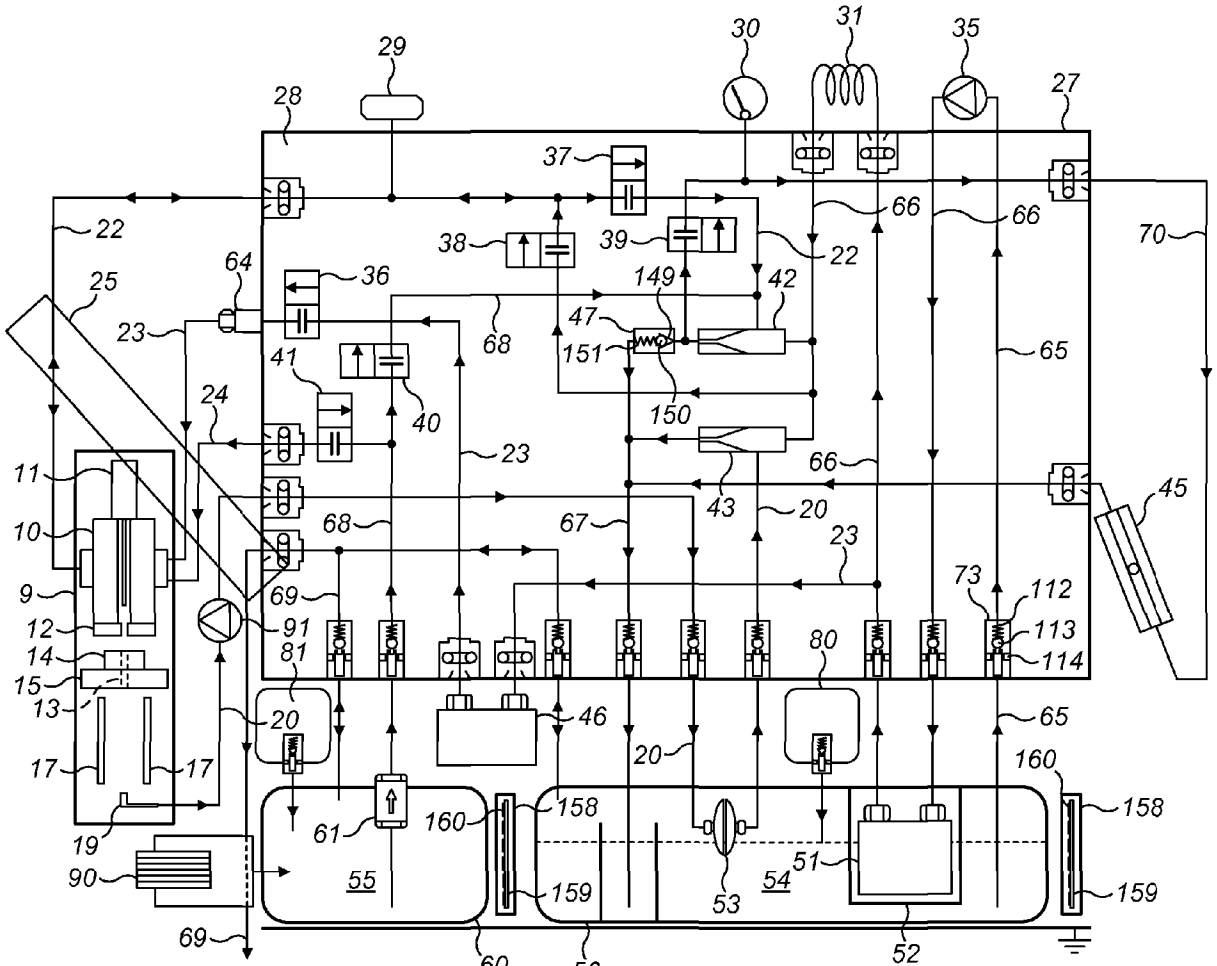
FIG. 1: shows an ink circuit included in a printer according to the invention.

Referring to FIG. 1, a main system ink pump 35 draws ink from the service module or ink reservoir 50, passes this ink through main filter 51 and then through a cooling facility in the form of heat exchanger 31. The ink then passes, still under pressure, through line 66, through jet pump 43, and back into the reservoir 50 through return line 67. The vacuum port of the jet pump 43 is connected to the gutter 19 of print head 9 through vacuum line 20. Thus ink from the gutter is entrained in the circulating ink and also returned to the reservoir 50 through return line 67.

In the conventional manner print head ink feed line 23 branches off the pressure line 66, preferably upstream of heat exchanger or cooler 31. Ink for printing passes down feed line 23 to the print head 9 via a damper 46 to remove any pressure ripples in the ink flow.

The system is configured so that the re-circulation circuit from, and back to, the reservoir 50 is a high flow/low pressure circuit while the ink feed line is low flow/high pressure. This balance is significantly influenced by the respective apertures of the print head 9 and jet pump 43, the net outcome being that the ink flow through the print head feed line 23 is of the order of 0.5% of the ink flow through the re-circulation circuit.

Thus a significant body of the ink within the printer is cooled.

Figure 2:
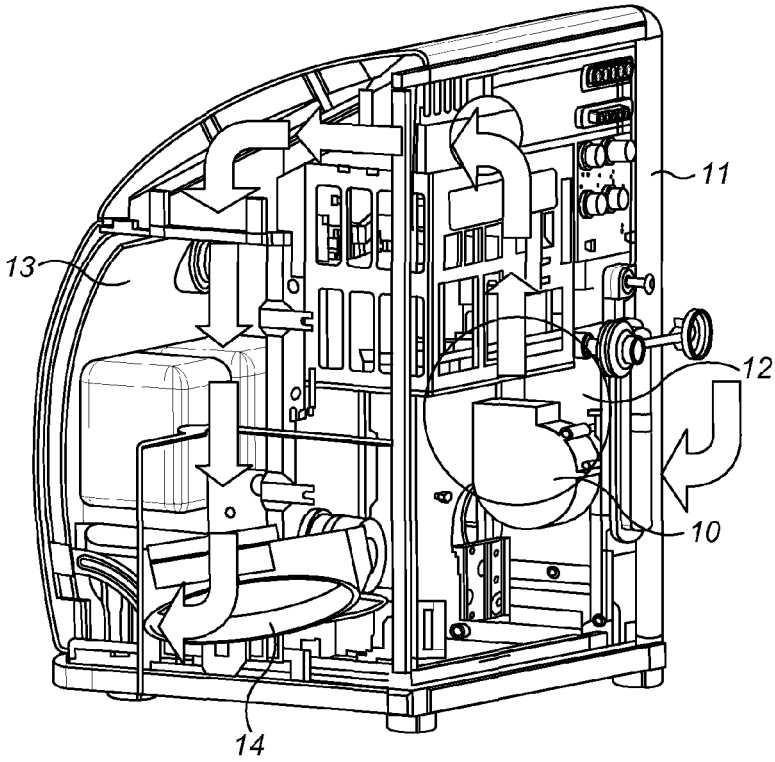
FIG. 2: shows a rear isometric view of an inkjet printer according to the invention with the exterior cladding removed.

Referring now to FIG. 2, the cooler 31 is conveniently situated closely adjacent to a cooling fan 10 used to create a flow of cooling air through the printer. In the particular embodiment shown the fan draws air in through one side 11 of the printer cabinet and passes the air through an electronics compartment 12 within the cabinet, over and into an ink system compartment 13 also within the housing, before exhausting the air stream out of the other side 14 of cabinet. It will be seen that the fan 10 is positioned within the electronics compartment closely adjacent to the inner surface of side 11.

Figure 3:
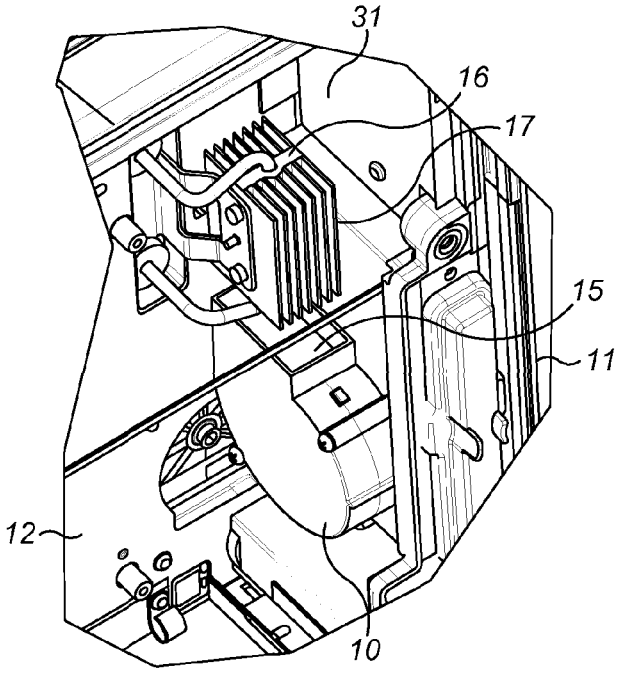
FIG. 3: shows an enlarged view of that which is shown in the circle in FIG. 2.

Turning to FIG. 3, the cooler 31 is preferably positioned just above the outlet 15 of the fan 10 so as to derive the greatest heat exchange with the moving air flow. In the form shown the cooler comprises an aluminium casting 16 through which the ink passes, the casting 16 including external fins 17 to increase the surface area exchanging heat with the air stream created by the fan 10.

The temperature reduction and solvent make-up saving will obviously depend on the configuration of the installation described however, by way of example only, we have found that a temperature reduction of 3° C. in a body of ink at about 10° C. above ambient can provide a solvent consumption saving in the order of 22%.

It will thus be appreciated that the invention, at least in the case of the working embodiment herein described, discloses a simple yet effective method and means for achieving a significant reduction of solvent consumption in a continuous inkjet printer.

The invention claimed is:

1. A continuous inkjet printer comprising:

a print head;

an ink reservoir;

an ink re-circulation circuit configured to draw ink from said ink reservoir and to return ink to said reservoir without directing ink through said print head; and a print head feed line, branching off said ink re-circulation circuit to supply ink to said print head;

wherein said printer further includes an ink cooling facility within said ink re-circulation circuit and wherein said print head feed line branches off said re-circulation circuit at a position upstream of said ink cooling facility so that ink passing through said print head feed line is not cooled by said cooling facility.

2. A printer as claimed in claim 1, wherein said ink re-circulation circuit begins and terminates in said ink reservoir, said ink cooling facility being provided within said ink re-circulating circuit external to said reservoir.

3. A printer as claimed in claim 2 wherein said cooling facility comprises a heat exchanger.

4. A printer as claimed in claim 3 further including a fan to pass an air stream over said heat exchanger.

* * * * *